US010184292B2

(12) United States Patent
Latimer et al.

(10) Patent No.: US 10,184,292 B2
(45) Date of Patent: Jan. 22, 2019

(54) STEPLADDER, SYSTEM AND METHOD

(75) Inventors: Brett A. Latimer, New Castle, PA (US); Tracee Leonardson, Ashtabula, OH (US)

(73) Assignee: Werner Co., Greenville, PA (US)

( * ) Notice: Subject to any disclaimer, the term of this patent is extended or adjusted under 35 U.S.C. 154(b) by 372 days.

(21) Appl. No.: 13/385,424

(22) Filed: Feb. 17, 2012

(65) Prior Publication Data

US 2012/0217093 A1 Aug. 30, 2012

Related U.S. Application Data

(60) Provisional application No. 61/463,961, filed on Feb. 25, 2011.

(51) Int. Cl.
*E06C 7/14* (2006.01)

(52) U.S. Cl.
CPC ..... *E06C 7/14* (2013.01)

(58) Field of Classification Search
CPC ..... E06C 7/14
USPC ..... 182/129, 119, 230; 248/238
See application file for complete search history.

(56) References Cited

U.S. PATENT DOCUMENTS

| | | | | |
|---|---|---|---|---|
| 4,653,713 | A * | 3/1987 | Hamilton | 248/238 |
| 6,138,963 | A * | 10/2000 | Malvasio | 248/111 |
| 6,401,862 | B1 * | 6/2002 | Caron | 182/129 |
| 6,997,282 | B1 * | 2/2006 | Sharp et al. | 182/200 |
| 7,540,560 | B1 * | 6/2009 | Connery | 297/149 |
| 7,658,265 | B1 * | 2/2010 | Dooley | 182/129 |
| 2007/0284191 | A1 * | 12/2007 | Astor et al. | 182/129 |
| 2009/0127146 | A1 * | 5/2009 | Krebs et al. | 206/373 |

* cited by examiner

*Primary Examiner* — Alvin Chin-Shue
*Assistant Examiner* — Kristine Florio
(74) *Attorney, Agent, or Firm* — Ansel M. Schwartz

(57) ABSTRACT

A stepladder system having an object having a lug slot. The system has a stepladder. The stepladder has a ladder top having a plane having a periphery and a lug extending from the periphery which engages with the lug slot in an object so the object is held securely to the ladder top. A method of holding securely an object to a stepladder.

4 Claims, 5 Drawing Sheets

LADDER
TOP

JOB
BUCKET

LADDER
TOP

PAINT
CUP

LADDER
TOP

PAINT
CUP

LADDER
TOP

PAINT
CUP

STEPLADDER, SYSTEM AND METHOD

CROSS-REFERENCE TO RELATED APPLICATIONS

This is a non-provisional application of U.S. provisional patent application Ser. No. 61/463,961 filed Feb. 25, 2011.

FIELD OF THE INVENTION

The present invention is related to ladder tops. More specifically, the present invention is related to ladder tops which have features to securely hold tools, paint and utensils to the top.

BACKGROUND OF THE INVENTION

For years, stepladders have been designed for the general construction and painting professionals needs. When using a ladder, it is common that tools, paint and other utensils are placed on the ladder top or carried up the ladder. It would be extremely helpful to a user to securely position tools, paint and other utensils on the ladder top for easy access by the user.

SUMMARY OF THE INVENTION

The present invention pertains to a stepladder system. The system comprises an object having a lug slot. The system comprises a stepladder. The stepladder comprises a ladder top having a plane having a periphery and a lug extending from the periphery which engages with the lug slot in the object so the object is held securely to the ladder top. The stepladder comprises a front section having a first front rail attached to the ladder top and a second front rail attached to the ladder top and rungs attached to the first front rail and to the second front rail. The stepladder comprises a rear section having a first rear rail attached to the ladder top and a second rear rail attached to the ladder top and rungs attached to the first rear rail and to the second rear rail. The rear section and a front section are able to pivot about the top and relative to each other to move between a use state where the front section and rear section form an angular relationship apart from each other, and a closed state where the front section and rear section are essentially in parallel with each other.

The present invention pertains to a stepladder system. The system comprises an object having a hook. The system comprises a stepladder. The stepladder comprises a ladder top having a plane having a periphery with a hook receiver which engages with the hook in the object so the object is held securely to the ladder top. The stepladder comprises a front section having a first front rail attached to the ladder top and a second front rail attached to the ladder top and rungs attached to the first front rail and to the second front rail. The stepladder comprises a rear section having a first rear rail attached to the ladder top and a second rear rail attached to the ladder top and rungs attached to the first rear rail and to the second rear rail. The rear section and the front section are able to pivot about the top and relative to each other to move between a use state where the front section and rear section form an angular relationship apart from each other, and a closed state where the front section and rear section are essentially in parallel with each other.

The present invention pertains to a stepladder which holds an object. The stepladder comprises a ladder top having a plane having a periphery and a lug extending from the periphery which engages with a lug slot in the object so the object is held securely to the ladder top. The stepladder comprises a front section having a first front rail attached to the ladder top and a second front rail attached to the ladder top and rungs attached to the first front rail and to the second front rail. The stepladder comprises a rear section having a first rear rail attached to the ladder top and a second rear rail attached to the ladder top and rungs attached to the first rear rail and to the second rear rail. The rear section and the front section are able to pivot about the top and relative to each other to move between a use state where the front section and rear section form an angular relationship apart from each other, and a closed state where the front section and rear section are essentially in parallel with each other.

The present invention pertains to a method of holding securely an object to a stepladder. The method comprises the steps of aligning a lug slot of an object over a lug extending from a ladder top of the stepladder. There is the step of moving the lug slot relative to the lug so the lug fits into the lug slot and engages with the lug slot so the object is held securely to the ladder top.

The present invention pertains to a method of holding securely an object to a stepladder. The method comprises the steps of aligning an extension tab, dove tab or T-tab of an object over a tab hole, dove slot or T-slot, respectively, of a ladder top of the stepladder. There is the step of moving the extension tab, dove tab or T-tab relative to tab hole, dove slot or T-slot, respectively, so the extension tab, dove tab or T-tab engages with the tab hole, dove slot or T-slot, respectively, so the object is held securely to the ladder top.

BRIEF DESCRIPTION OF THE DRAWINGS

In the accompanying drawings, the preferred embodiment of the invention and preferred methods of practicing the invention are illustrated in which.

DETAILED DESCRIPTION

Figure 1:
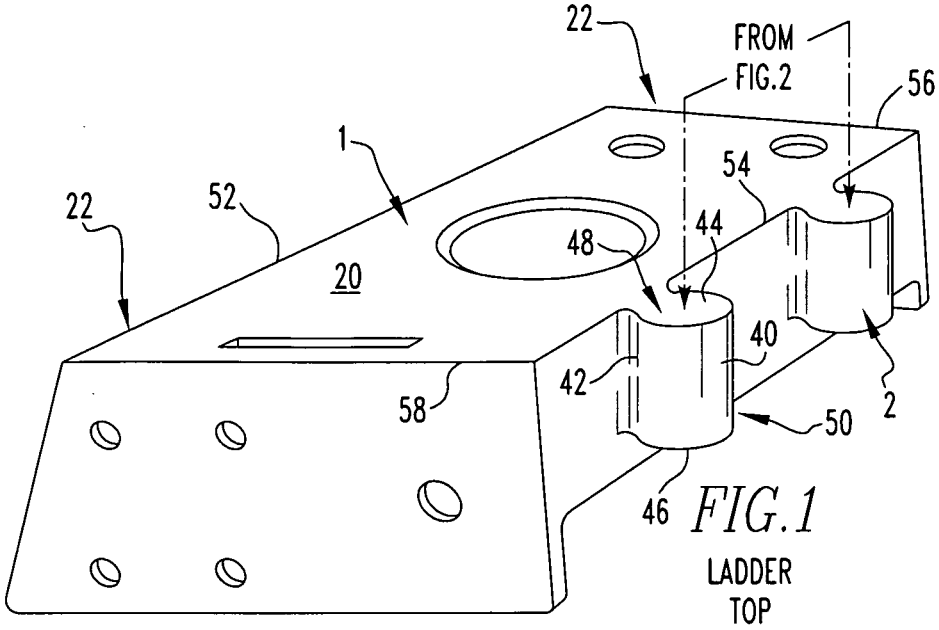
FIG. 1 shows a ladder top with lugs.
Figure 2:
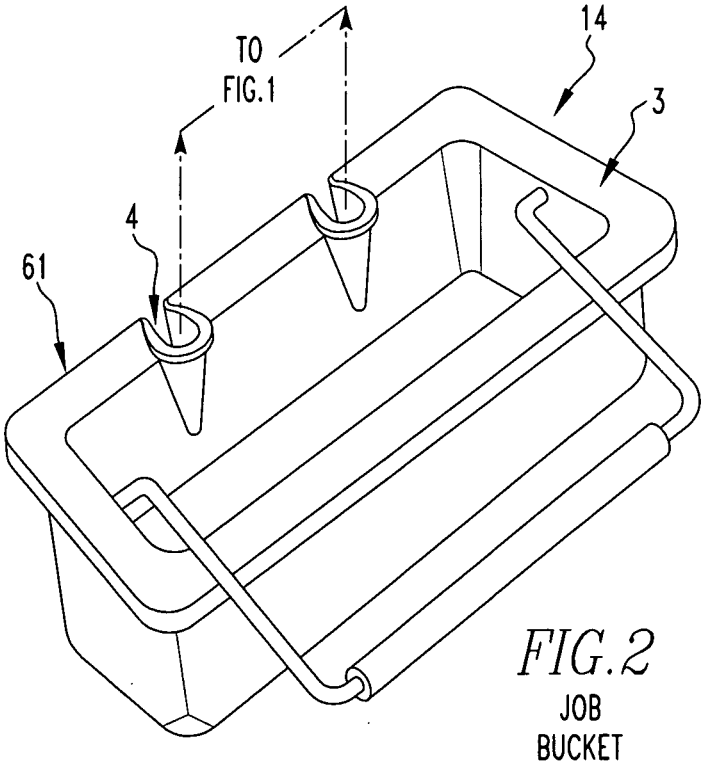
FIG. 2 shows a job bucket with lug slots.
Figure 8:
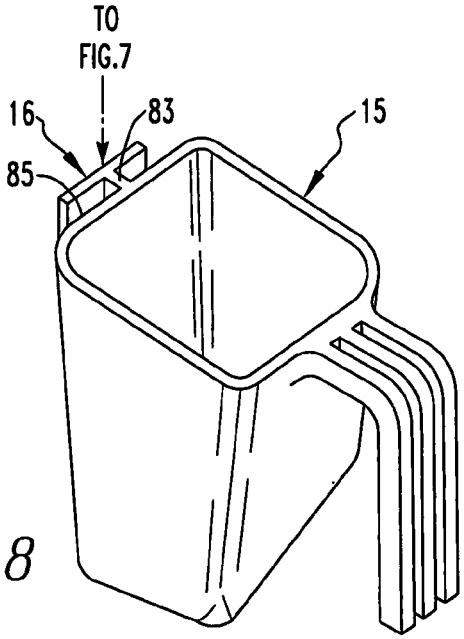
FIG. 8 shows a paint cup with a T-tab.
Figure 9:
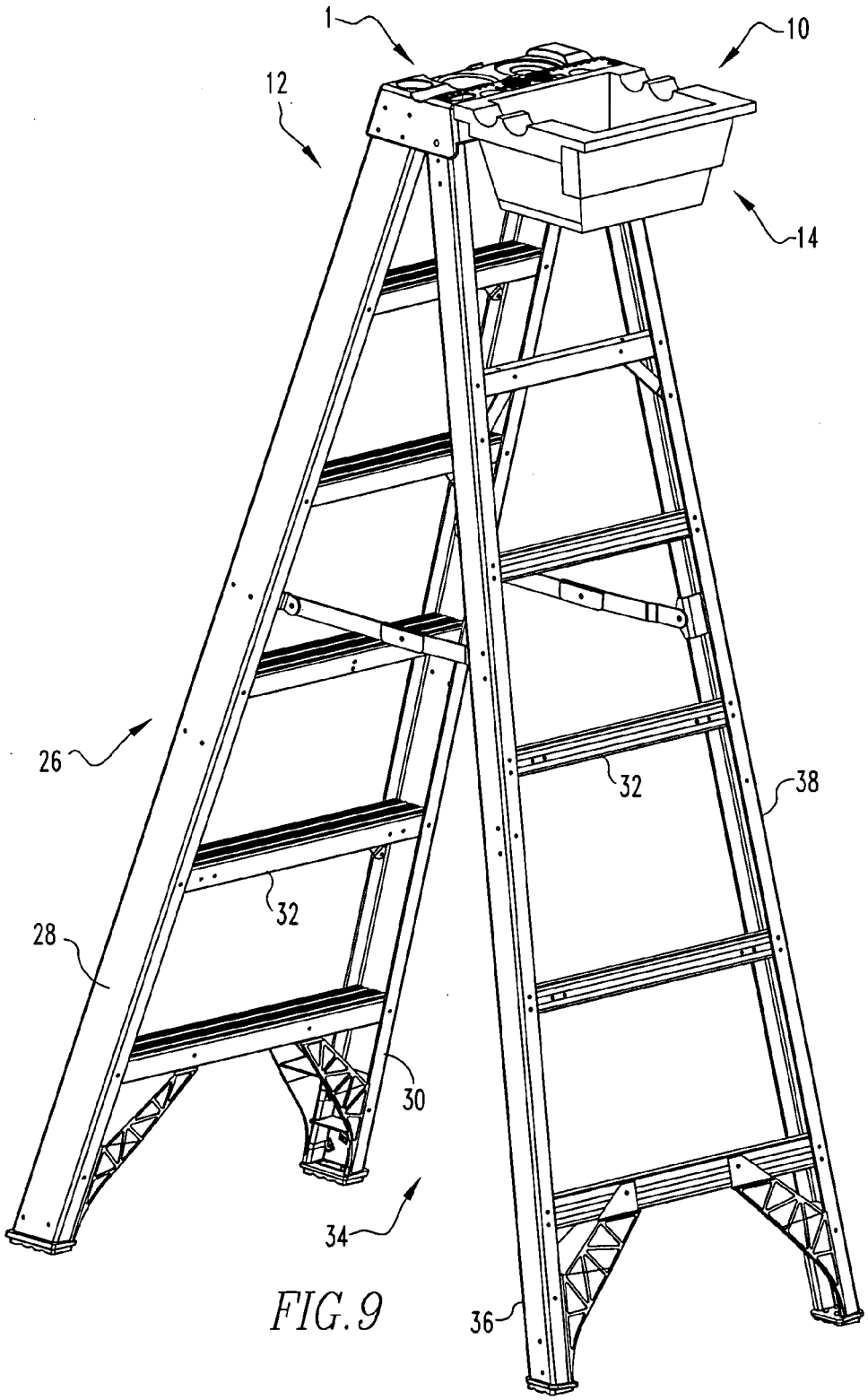
FIG. 9 shows a stepladder with a ladder top of the present invention.

Referring now to the drawings wherein like reference numerals refer to similar or identical parts throughout the several views, and more specifically to FIGS. 1, 2 and 8 thereof, there is shown a stepladder system 10. The system 10 comprises an object 14 having a lug slot 4. The system 10 comprises a stepladder 12. The stepladder 12 comprises a ladder top 1 having a plane 20 having a periphery 22 and a lug 2 extending from the periphery 22 which engages with the lug slot 4 in the object 14 so the object 14 is held securely to the ladder top 1. The stepladder 12 comprises a front section 26 having a first front rail 28 attached to the ladder top 1 and a second front rail 30 attached to the ladder top 1 and rungs 32 attached to the first front rail 28 and to the second front rail 30. The stepladder 12 comprises a rear section 34 having a first rear rail 36 attached to the ladder top 1 and a second rear rail 38 attached to the ladder top 1 and rungs 32 attached to the first rear rail 36 and to the second rear rail 38. The rear section 34 and the front section 26 are able to pivot about the top 44 and relative to each other to move between a use state where the front section 26 and rear section 34 form an angular relationship apart from each other, and a closed state where the front section 26 and rear section 34 are essentially in parallel with each other. The object 14 may be a job bucket 3.

The plane 20 and periphery 22 may be one continuous piece. The lug 2 may have a shape that conforms with the slots say so the object 14 is held securely to the plane 20. The lug 2 may have a front 40 and a back 42 with the front 40 attached to the periphery 22 of the plane 20 and being narrower than the back 42. The lug 2 may have a top 44 and a bottom 46 with the top's width different then the bottom's width. The lug 2 may have an engagement portion 48 forming the back 42 that has a shape essentially of a cone or a cylinder and an extension portion 50 forming the front 40 that extends from a side of the ladder top 1 and connects with the engagement portion 48. The periphery 22 may have essentially a rectangular shaped, and the plane 20 may have a first side 52 and a second side 54 opposing the first side 52, and a third side 56 and a fourth side 58 opposing the third side 56. The third side 56 and the fourth side 58 attached to the first and second sides 52, 54.

The present invention pertains to a stepladder system 10 as shown in FIGS. 3-8. The system 10 comprises an object 14 having a hook 60. The system 10 comprises a stepladder 12. The stepladder 12 comprises a ladder top 1 having a plane 20 having a periphery 22 with a hook receiver 62 which engages with the hook 60 in the object 14 so the object 14 is held securely to the ladder top 1. The stepladder 12 comprises a front section 26 having a first front rail 28 attached to the ladder top 1 and a second front rail 30 attached to the ladder top 1 and rungs 32 attached to the first front rail 28 and to the second front rail 30. The stepladder 12 comprises a rear section 34 having a first rear rail 36 attached to the ladder top 1 and a second rear rail 38 attached to the ladder top 1 and rungs 32 attached to the first rear rail 36 and to the second rear rail 38. The rear section 34 and the front section 26 are able to pivot about the top 44 and relative to each other to move between a use state where the front section 26 and rear section 34 form an angular relationship apart from each other, and a closed state where the front section 26 and rear section 34 are essentially in parallel with each other.

The hook 60 may be either an extension tab, dove tab or T-tab, and the hook receiver 62 is either a tab hole, dove slot or T-slot that engages with the extension tab, dove tab or T-tab, respectively.

The present invention pertains to a stepladder 12 which holds an object 14. The stepladder 12 comprises a ladder top 1 having a plane 20 having a periphery 22 and a lug 2 extending from the periphery 22 which engages with a lug slot 4 in an object 14 so the object 14 is held securely to the ladder top 1. The stepladder 12 comprises a front section 26 having a first front rail 28 attached to the ladder top 1 and a second front rail 30 attached to the ladder top 1 and rungs 32 attached to the first front rail 28 and to the second front rail 30. The stepladder 12 comprises a rear section 34 having a first rear rail 36 attached to the ladder top 1 and a second rear rail 38 attached to the ladder top 1 and rungs 32 attached to the first rear rail 36 and to the second rear rail 38. The rear section 34 and the front section 26 are able to pivot about the top 44 and relative to each other to move between a use state where the front section 26 and rear section 34 form an angular relationship apart from each other, and a closed state where the front section 26 and rear section 34 are essentially in parallel with each other.

The present invention pertains to a method of holding securely an object 14 to a stepladder 12. The method comprises the steps of aligning a lug slot 4 of an object 14 over a lug 2 extending from a ladder top 1 of the stepladder 12. There is the step of moving the lug slot 4 relative to the lug 2 so the lug 2 fits into the lug slot 4 and engages with the lug slot 4 so the object 14 is held securely to the ladder top 1.

The present invention pertains to a method of holding securely an object 14 to a stepladder 12. The method comprises the steps of aligning an extension tab, dove tab or T-tab of an object 14 over a tab hole, dove slot or T-slot, respectively, of a ladder top 1 of the stepladder 12. There is the step of moving the extension tab, dove tab or T-tab relative to the tab hole, dove slot or T-slot, respectively, so the extension tab, dove tab or T-tab engages with the tab hole, dove slot or T-slot, respectively, so the object 14 is held securely to the ladder top 1.

Referring to FIG. 1, the ladder top 1 has two lugs 2 extending from the top's periphery 22. Each lug 2 can extend from the top 44 to the bottom 46 of the ladder top 1, or only a portion of the height of the ladder top 1. FIG. 2 shows the object is a job bucket 3 having two lug slots 4 disposed in the bucket's side and positioned to align with the lugs 2 on the ladder top 1 so the lug slots 4 of the job bucket 3 can be positioned on the lugs 2 so the lugs 2 and the lug slots 4 engage and hold the job bucket 3 securely to the ladder top 1. Ideally, the shape of each lug slot 4 conforms with the shape of the lug 22 which it engages to provide a secure fit to hold the job bucket 3 to the ladder top 1. If desired, although not shown, there can be additional lugs placed about the periphery 22 of the ladder top 1 on different sides of the ladder top 1 so that additional objects which also have lug slots 4 can engage the additional lugs 2 on the different sides of the ladder top 1 so that more than one object 14 may be securely held to the ladder top 1.

Figure 3:
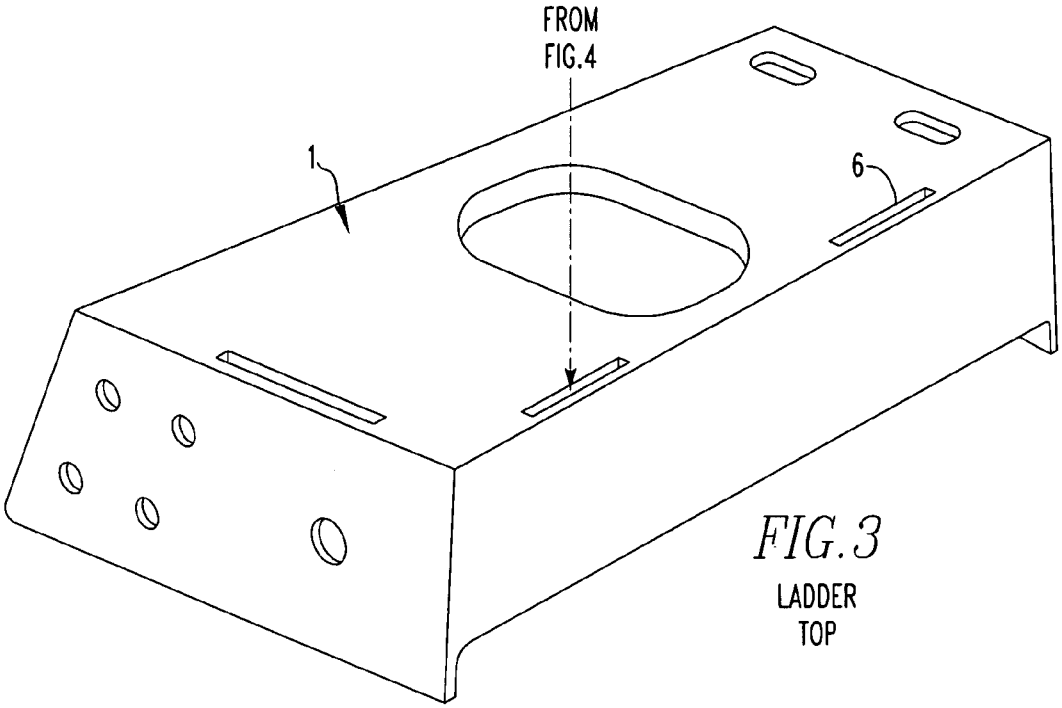
FIG. 3 shows a ladder top with tab holes.
Figure 4:
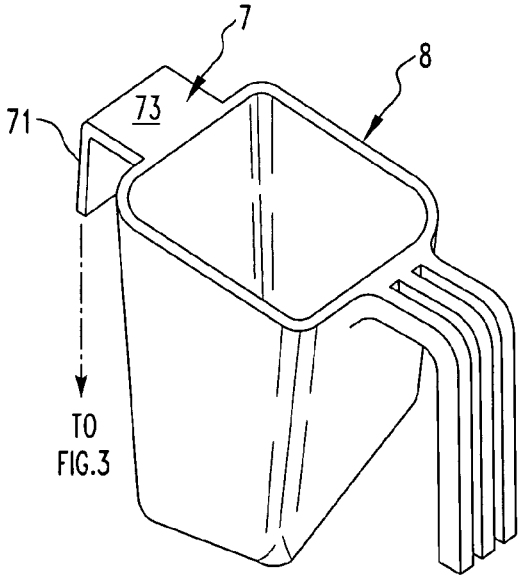
FIG. 4 shows a paint cup with an extension tab.

FIG. 3 shows another embodiment of a ladder top 1 having hook receivers 62 as tab holes 6 disposed in the plane 20 of the ladder top 1. These holes 6 receive extension hooks 60 as tabs 7 that extend from an object 14, such as a paint cup 8, so when the extension tab 7 of the paint cup 8 is inserted into the tab hole 6, the paint cup 8 is securely held to the ladder top 1. The extension tab 7 may be designed so that it has a vertical portion 71 that is inserted into and extends down from the tab hole 6 in the ladder top 1, and a horizontal portion 73 which extends from the tab hole 6 out over the periphery 22 of the ladder top 1 from the tab hole 6 so the paint cup 8 clears the side of the ladder top 1, but is held securely in place to the ladder top 1. The paint cup 8 may have a handle to assist in moving the paint cup 8.

Figure 5:
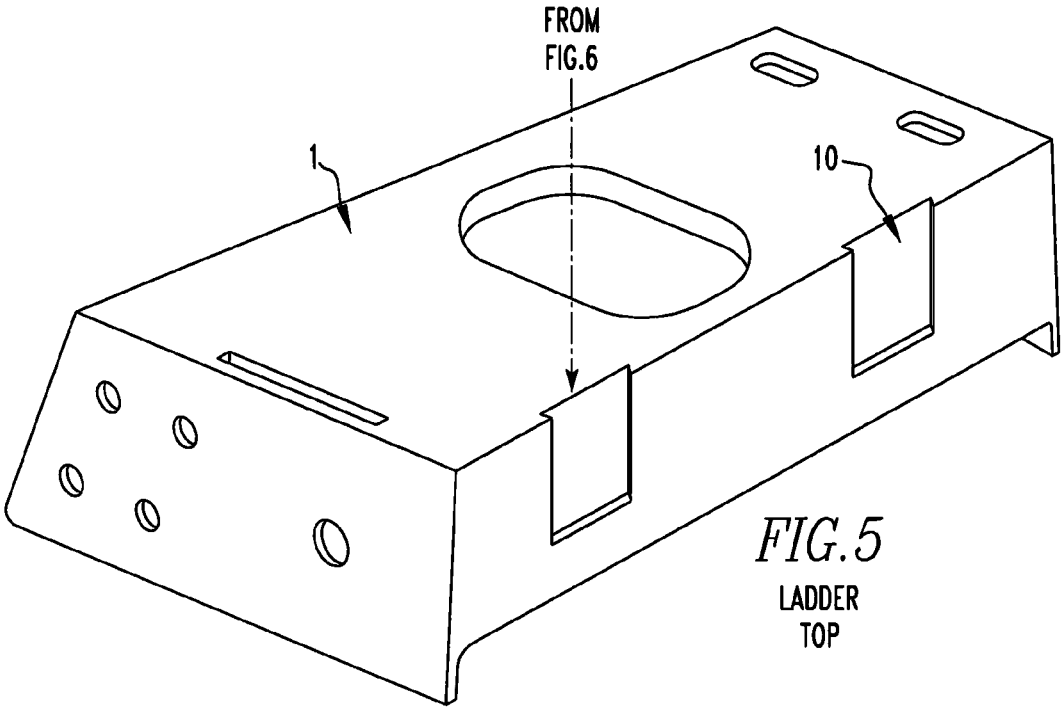
FIG. 5 shows a ladder top with dove slots.
Figure 6:
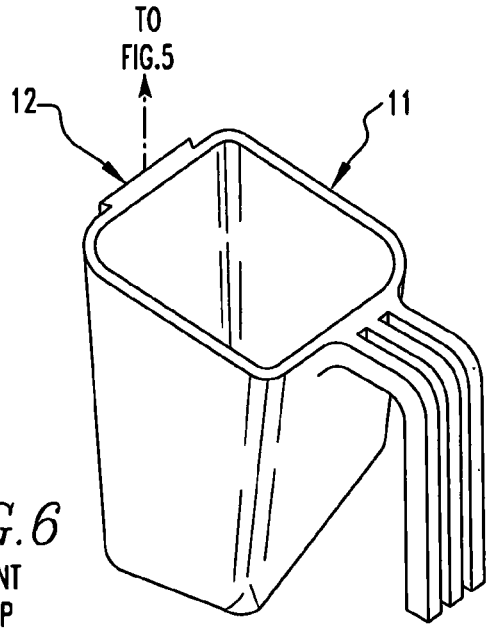
FIG. 6 shows a paint cup with a dove tab.

Referring to FIGS. 5 and 6, there is an alternative embodiment of the ladder top 1 and the paint cup 11. In the embodiment shown in FIGS. 5 and 6, the ladder top 1 has dove slots 10 instead of tab holes 6, and the paint cup 11 has a dove tab 12 instead of an extension tab 7. The shape of the dove tab 12 conforms with the shape of the dove slot 10 so that when the dove tab 12 is inserted into the dove slot 10, the paint cup is securely held to the ladder top 1. The shape of the dove tab is such that it has a narrower width closest to the point that it extends from the paint cup 11 and is wider in width at the front 40 of the dove tab 12. The dove slot 10 has a corresponding shape where the width of the dove tab is wider along the face of the side of the ladder top 1 that has the dove slot and is narrower in width at the rear of the dove slot so that the dove tab 12 basically hooks with the dove slot 10. The cross-section of the dove slot 12 can be said to form a partial V, with the same being used to identify the shape of the dove slot 10. It should be noted though that essentially any shape can be used between the dove slot 10 and the dove tab 12 so they form a hooking engagement to securely hold the paint cup 11 to the ladder top 1.

Figure 7:
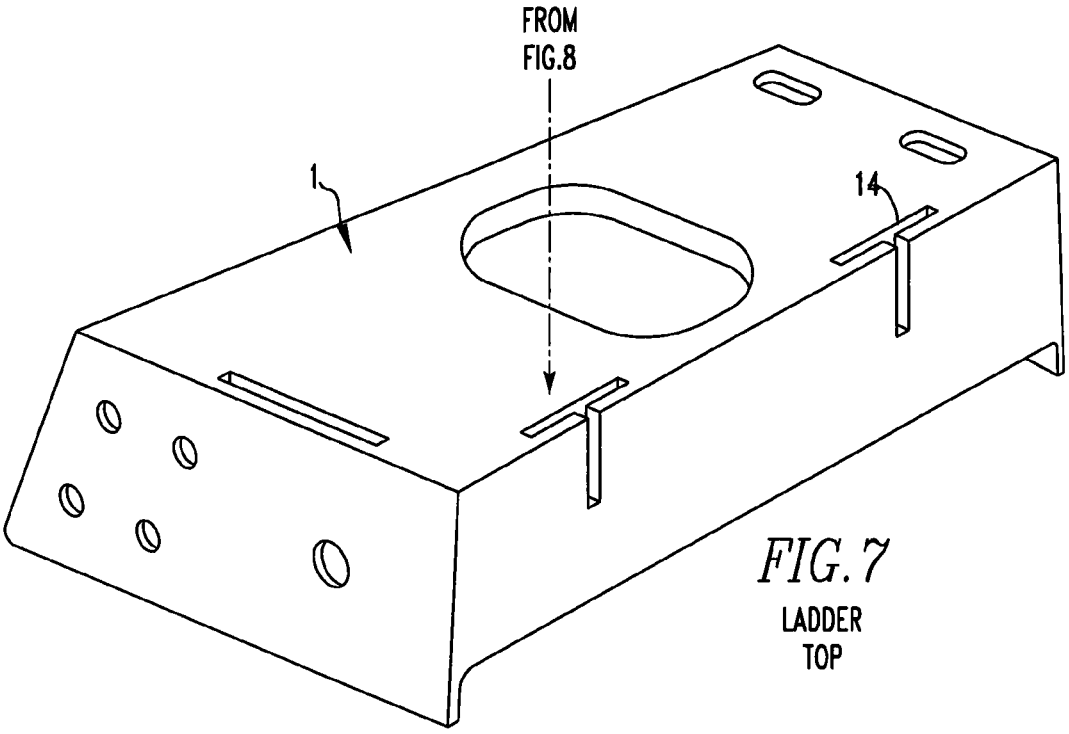
FIG. 7 shows a ladder top with T-slots.

Referring to FIGS. 7 and 8, there is yet another alternative embodiment shown of the ladder top 1 and the paint cup 15. Again, it should be noted that while the paint cup 15 is used as an example to describe the relationship between the ladder top 1 and an object 14, here a paint cup 15, other types of objects, such as the job bucket 3 can be also used with the types of hooking engagement shown. In FIG. 7, the ladder top 1 has T-slots 14 disposed in the periphery 22 of the ladder top 1, instead of the dove slots or holes, as previously described. Similarly, the paint cup has T-tabs 16 that extend from the paint cup 15 and engage with the T-slot in the ladder top 1 to securely hold the paint cup 15 to the ladder top 1. The T-slot 16 essentially has a cross-section of a T, with a horizontal portion 83 disposed in the plane 20 of the ladder top 1, and a vertical portion 85 disposed in the side of the ladder top 1 and connected with the horizontal portion to form the T. So really, the T-tab has a cross-section of a T with a vertical portion that extends through and down from the horizontal portion of the T-slot 14 in the ladder top 1. The T-tab also has a horizontal portion that extends from the paint cup 15 to the vertical portion of the T-tab which rests on and fits into the side of the ladder top 1 having the T-slot and fits into the vertical portion of the T-slot.

The top 1 also has many features designed for holding tools, paint and utensils. The top 1 has holes 22 that may hold hammer/drill holster, screwdrivers, pliers, channel locks, side cutters and pliers, and wire strippers. Each of the said features has a raised icon next to it for easy identification.

Although the invention has been described in detail in the foregoing embodiments for the purpose of illustration, it is to be understood that such detail is solely for that purpose and that variations can be made therein by those skilled in the art without departing from the spirit and scope of the invention except as it may be described by the following claims.

What is claimed is:

1. A stepladder system comprising:

an object having a hook, the object having the hook being a one-piece paint cup having a handle, and an extension tab; and a stepladder comprising:

a ladder top having a plane having a periphery with a hook receiver which engages with the hook in the object so the object is held securely to the ladder top, the hook receiver is a tab hole so when the extension tab of the paint cup is inserted into the tab hole, the paint cup is securely held to the ladder top, the extension tab has a vertical portion that is inserted into and extends down from the tab hole in the ladder top, and a horizontal portion which extends from the tab hole out over the periphery of the ladder top from the tab hole so the paint cup clears the side of the ladder top, but is held security in place to the ladder top, the ladder top having a first side, a second side, a third side and a fourth side, all of which extend down from the plane, the first side opposing the second side with the plane therebetween, the third side opposing the fourth side with the plane therebetween, the third side and fourth side connected to the first and second side, the hook receiver adjacent the second side, the cup having a perimeter wall having an opening with a cross-section less than half of the top's length, the handle having a horizontal portion that extends outward from the perimeter's side, the handle having a vertical portion extending perpendicularly downward from the horizontal portion so the vertical and horizontal portions together forming an L shape, the extension tab extending outward from the perimeter wall and in opposition with the handle;

a front section having a first front rail attached to the ladder top and a second front rail attached to the ladder top and rungs attached to the first front rail and to the second front rail; and a rear section having a first rear rail attached to the ladder top and a second rear rail attached to the ladder top and rungs attached to the first rear rail and to the second rear rail, the rear section and a front section able to pivot about the top and relative to each other to move between a use state where the front section and rear section form an angular relationship apart from each other, and a closed state where the front section and rear section are essentially in parallel with each other, the second side of the ladder top disposed over the rear section, the paint cup being over the rear section of the ladder.

2. A method of holding securely an object to a stepladder comprising the steps of:

aligning an extension tab, dove tab or T-tab of an object, the object being a one-piece paint cup having a handle, over a tab hole, dove slot or T-slot, respectively, of a ladder top of the stepladder, the ladder top having a plane having a periphery with the tab hole, dove slot or T-slot which engages with the extension tab, dove tab or T-tab in the object so the object is held securely to the ladder top, the ladder top having a first side, a second side, a third side and a fourth side, all of which extend down from the plane, the first side opposing the second side with the plane therebetween, the third side opposing the fourth side with the plane therebetween, the third side and fourth side connected to the first and second side, the tab hole, dove slot or T-slot adjacent the second side, the stepladder having a front section and a rear section, the second side of the ladder top disposed over the rear section, the cup having a perimeter wall having an opening with a cross-section less than half of the top's length, the handle having a horizontal portion that extends outward from the perimeter's side, the handle having a vertical portion extending perpendicularly downward from the horizontal portion so the vertical and horizontal portions together forming an L shape, the extension tab, dove tab or T-tab extending outward from the perimeter wall and in opposition with the handle; and moving the extension tab, dove tab or T-tab relative to the tab hole, dove slot or T-slot, respectively, so the extension tab, dove tab or T-tab engages with the tab hole, dove slot or T-slot, respectively, so the object is held securely to the ladder top, the paint cup being over the rear section of the ladder.

3. A stepladder system comprising:

an object having a hook, the object having the hook being a one-piece paint cup having a handle, and a dove tab; and a stepladder comprising:

a ladder top having a plane having a periphery with a hook receiver which engages with the hook in the object so the object is held securely to the ladder top, the hook receiver is a dove slot, the shape of the dove tab conforms with the shape of the dove slot so that when the dove tab is inserted into the dove slot, the paint cup is security held to the ladder top, the shape of the dove tab is such that it has a narrower width closest to the point that it extends from the paint cup and is wider in width at the front of the dove tab, the dove slot has a corresponding shape where the width of the dove tab is wider along the face of the side of the ladder top that has the dove slot and is narrower in width at the rear of the dove slot so that the dove tab basically hooks with the dove slot, the cross-section of the dove slot forms a partial V, with the shape of the dove slot also forms a partial V, the ladder top having a first side, a second side, a third side and a fourth side, all of which extend down from the plane, the first side opposing the second side with the plane therebetween, the third side opposing the fourth side with the plane therebetween, the third side and fourth side connected to the first and second side, the hook receiver adjacent the second side, the cup having a perimeter wall having an opening with a cross-section less than half of the top's length, the handle having a horizontal portion that extends outward from the perimeter's side, the handle having a vertical portion extending perpendicularly downward from the horizontal portion so the vertical and horizontal portions together forming an L shape, the hook extending outward from the perimeter wall and in opposition with the handle;

a front section having a first front rail attached to the ladder top and a second front rail attached to the ladder top and rungs attached to the first front rail and to the second front rail; and a rear section having a first rear rail attached to the ladder top and a second rear rail attached to the ladder top and rungs attached to the first rear rail and to the second rear rail, the rear section and a front section able to pivot about the top and relative to each other to move between a use state where the front section and rear section form an angular relationship apart from each other, and a closed state where the front section and rear section are essentially in parallel with each other, the second side of the ladder top disposed over the rear section, the paint cup being over the rear section of the ladder.

4. A stepladder system comprising:

an object having a hook, the object having the hook being a one-piece paint cup having a handle, and a T-tab; and a stepladder comprising:

a ladder top having a plane having a periphery with a hook receiver which engages with the hook in the object so the object is held securely to the ladder top, the hook receiver is a T-slot, the T-tabs extend from the paint cup and engage with the T-slot in the ladder top to securely hold the paint cup to the ladder top, the T-slot essentially has a cross-section of a T, with a horizontal portion disposed in the plane of the ladder top, and a vertical portion disposed in the side of the ladder top and connected with the horizontal portion to form the T, the T-tab has a cross-section of a T with a vertical portion that extends through and down from the horizontal portion of the T-slot in the ladder top, the T-tab also has a horizontal portion that extends from the paint cup to the vertical portion of the T-tab which rests on and fits into the side of the ladder top having the T-slot and fits into the vertical portion of the T-slot, the ladder top having a first side, a second side, a third side and a fourth side, all of which extend down from the plane, the first side opposing the second side with the plane therebetween, the third side opposing the fourth side with the plane therebetween, the third side and fourth side connected to the first and second side, the hook receiver adjacent the second side, the cup having a perimeter wall having an opening with a cross-section less than half of the top's length, the handle having a horizontal portion that extends outward from the perimeter's side, the handle having a vertical portion extending perpendicularly downward from the horizontal portion so the vertical and horizontal portions together forming an L shape, the T-tab extending outward from the perimeter wall and in opposition with the handle;

a front section having a first front rail attached to the ladder top and a second front rail attached to the ladder top and rungs attached to the first front rail and to the second front rail; and a rear section having a first rear rail attached to the ladder top and a second rear rail attached to the ladder top and rungs attached to the first rear rail and to the second rear rail, the rear section and a front section able to pivot about the top and relative to each other to move between a use state where the front section and rear section form an angular relationship apart from each other, and a closed state where the front section and rear section are essentially in parallel with each other, the second side of the ladder top disposed over the rear section, the paint cup being over the rear section of the ladder.

* * * * *